US007234317B2

(12) United States Patent
Jenkins, Jr. et al.

(10) Patent No.: US 7,234,317 B2
(45) Date of Patent: Jun. 26, 2007

(54) AIR TUNNEL DIVERTER AND METHOD OF INSTALLING SAME

(75) Inventors: James H. Jenkins, Jr., South Amana, IA (US); Richard F. Seman, Sr., Middlefield, OH (US)

(73) Assignee: Maytag Corporation, Newton, IA (US)

( * ) Notice: Subject to any disclaimer, the term of this patent is extended or adjusted under 35 U.S.C. 154(b) by 437 days.

(21) Appl. No.: 10/819,869

(22) Filed: Apr. 7, 2004

(65) Prior Publication Data

US 2005/0076669 A1 Apr. 14, 2005

Related U.S. Application Data

(63) Continuation-in-part of application No. 10/195,785, filed on Jul. 15, 2002, now Pat. No. 6,732,543.

(60) Provisional application No. 60/305,715, filed on Jul. 16, 2001.

(51) Int. Cl.
*F25D 17/04* (2006.01)

(52) U.S. Cl. ..... 62/407

(58) Field of Classification Search ..... 62/407, 62/441, 404

See application file for complete search history.

(56) References Cited

U.S. PATENT DOCUMENTS 2,746,480 A 5/1956 Hildyard
4,250,800 A * 2/1981 Brockmeyer ..... 454/306
4,909,547 A * 3/1990 Guy ..... 285/148.28
4,966,202 A * 10/1990 Bryan et al. ..... 138/172
5,143,122 A * 9/1992 Adkins ..... 138/109
5,295,719 A 3/1994 Palu'
5,305,799 A 4/1994 Dal Palû
5,447,341 A 9/1995 Häartel et al.
5,495,726 A 3/1996 Lee

FOREIGN PATENT DOCUMENTS

DE 2453796 5/1976
EP 0 184 241 10/1990
GB 2 244 671 A 12/1991

* cited by examiner

*Primary Examiner*—Melvin Jones
(74) *Attorney, Agent, or Firm*—McKee, Voorhees & Sease, P.L.C.

(57) ABSTRACT

An air tunnel diverter for a refrigeration unit includes one or more leg members secured to a hub. The hub is generally formed to include a fitting through which cooler air is passed to the leg member and routed into the desired locations within the refrigerated space. The leg member is placed on the fitting by sliding one end of the leg member onto a leg portion of the fitting. The fitting is then secured to the leg member by an overmolding process in which a soft flexible plastic is cast or otherwise applied around the connection. Installation is further simplified by providing the leg member with a flexible portion. The air tunnel diverter is preferably secured in the refrigeration unit by foam insulation.

1 Claim, 3 Drawing Sheets

AIR TUNNEL DIVERTER AND METHOD OF INSTALLING SAME

CROSS-REFERENCE TO RELATED APPLICATIONS

This application is a continuation-in-part and claims benefit from U.S. application Ser. No. 10/195,785 filed Jul. 15, 2002, which is a continuation-in-part of U.S. Provisional Application No. 60/305,715 entitled "AIR TUNNEL DIVERTER" filed Jul. 16, 2001, all of which are incorporated herein by reference.

BACKGROUND OF THE INVENTION

The present invention relates generally to an air tunnel diverter and the method for installing the same in a refrigeration unit. More particularly, though not exclusively, the present invention relates to an air tunnel diverter that can be easily assembled and installed.

Air tunnel diverters are commonly used on refrigeration units, such as household refrigerators. Air tunnel diverters typically have a plurality of pipes and are used to route cool air, usually from a freezer compartment, to various fresh food areas or compartments in the refrigerator compartment or into various refrigerated spaces. To maximize efficiency, it is desirable to have all of the cooler air come from a single location or pump. This requires a plurality of pipes be merged into a single fitting to receive the cooler air or that the pipes be flexible and thus able to be positioned to rout chilled air to the desired locations. Current air tunnel diverters attempt to merge several pipes into the fitting using glue.

Glue is messy and often ineffective, failing to properly seal the air tunnel diverters. If the air tunnel diverters are not properly sealed, the foam insulation, which is typically sprayed on, may creep into the interior of the diverter, thereby reducing the diverters' effectiveness.

Current refrigeration units come in many styles and have a wide variety of specialized compartments. As designs evolve and change, the location of the various compartments also changes. Many homes may soon feature vent only refrigerators, but also refrigerated drawers, cabinents, and other refrigerated spaces. Previously, cooler air was typically routed to these areas through rigid pipes that were designed for a certain style of refrigerator with compartments in certain specified locations. Designing compartments in new locations also required designing a new air tunnel diverter to route the cooler air to the new locations. It is therefore desirable to have an air tunnel diverter that can be easily adapted or positioned to fit in a variety of refrigerated spaces.

Accordingly, a primary feature of the present invention is the provision of an air tunnel diverter and the method for installing the same in a refrigeration unit that overcomes problems found in the prior art.

Another feature of the present invention is the provision of an air tunnel diverter and the method for installing the same in a refrigeration unit that does not require glue for installation.

A further feature of the present invention is the provision of an air tunnel diverter and the method for installing the same in a refrigeration unit that is easily adapted for installation in a variety of refrigeration units.

A still further feature of the present invention is the provision of an air tunnel diverter and the method for installing the same in a refrigeration unit that is easy to install.

Yet another feature of the present invention is the provision of an air tunnel diverter and the method for installing the same in a refrigeration unit that is inexpensive.

These and other features and advantages will become apparent from the following specification and claims.

BRIEF SUMMARY OF THE INVENTION

The present invention generally comprises a refrigeration unit including an air tunnel diverter and the method for installing the same. More specifically, the present invention generally includes an air tunnel diverter having a hub with one or more air tubes extending therefrom. The air tubes are secured to the hub and sealed with an overmold of a soft plastic flexible material. The air tubes are then inserted into the mullion area of the refrigeration unit or as needed to direct cooled air into refrigerated spaces. Each air tube preferably terminates in a fitting. The flexibility of the air tube allows the installer to easily position the fittings into the desired locations. Once properly positioned, the air tunnel diverter is secured in place by the surrounding insulation material in the mullion.

DETAILED DESCRIPTION OF THE INVENTION

The present invention will be described as it applies to its preferred embodiment. It is not intended that the present invention be limited to the preferred embodiment. It is intended that the invention cover all modifications and alternatives that may be included within the spirit and scope of the invention.

Figure 1:
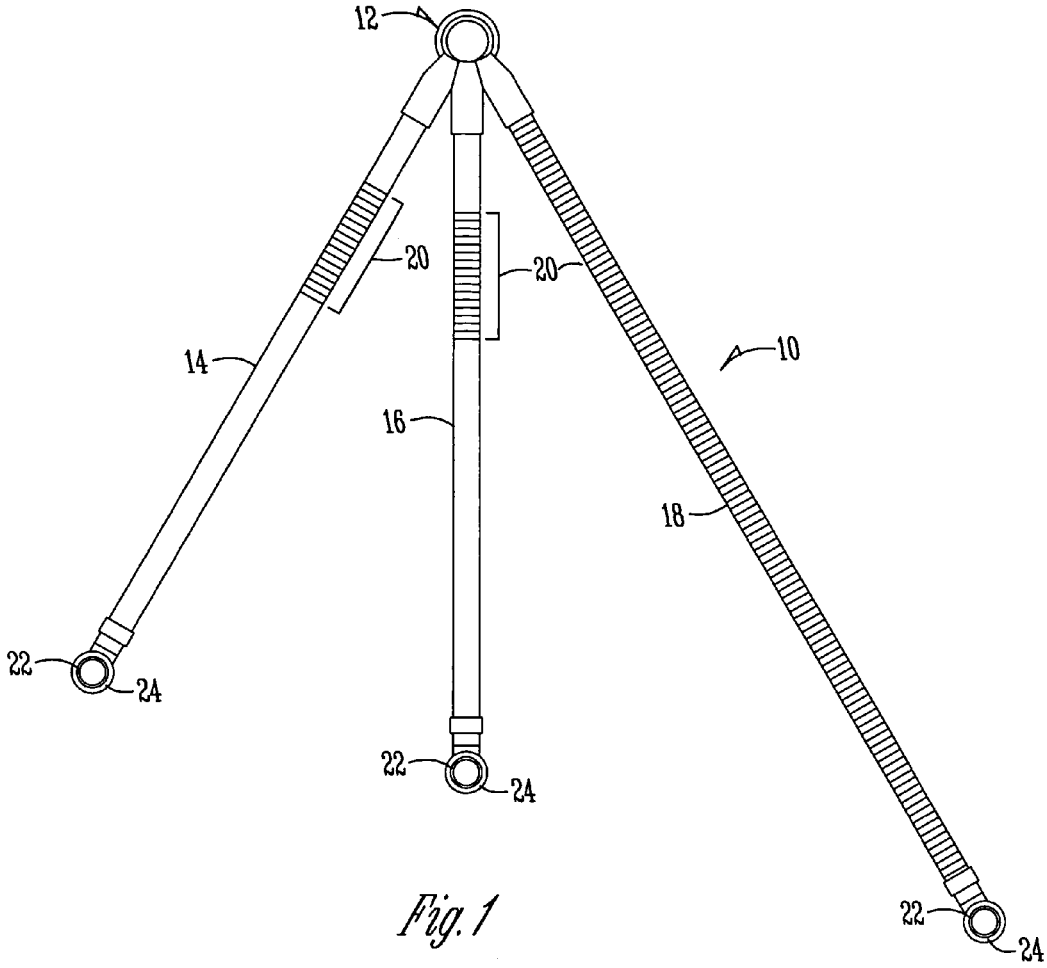
FIG. 1 is a top view of an exemplary air tunnel diverter constructed in accordance with the present invention.

The present invention relates to fluid distribution devices generally referred to as air tunnel diverters and, in particular, to their configuration and fabrication. FIGS. 1–5 depict an exemplary diverter 10 having, generally, a central hub 12 and one or more leg members (three shown in FIGS. 1 & 2) 14, 16, and 18 that extend outwardly therefrom. As FIG. 1 illustrates best, each of the leg members 14, 16, 18 is a tubular member that is typically fashioned of a polyethylene or another durable and substantially rigid plastic. Each of the leg members 14, 16, 18 has a flexible section 20 that permits the length of the respective leg members to be lengthened or shortened as desired. The flexible section 20 is preferably corrugated which also permits the leg members to be articulated or extended to some degree if necessary. This allows the air tunnel diverter 10 to be adapted to fit in a wide variety of refrigerators.

Fittings 22 are preferably elbow shaped fittings and are secured at the distal end of each leg member 14, 16, 18. Preferably, the fittings 22 are overmolded out of a soft flexible plastic material such as a thermal plastic elastomer such as SANTOPRENE®. The overmolding process creates the fittings 22 over the ends of the leg members 14, 16, 18, thereby sealing the connection between the leg members 14, 16, 18 and the fittings 22. Each of the fittings 22 have a radially outwardly extending flange 24 to seal the fittings 22 and the air tunnel diverter 10 to the desired compartments within a refrigerator. The flange 24 is preferably formed during the overmolding process.

Figure 2:
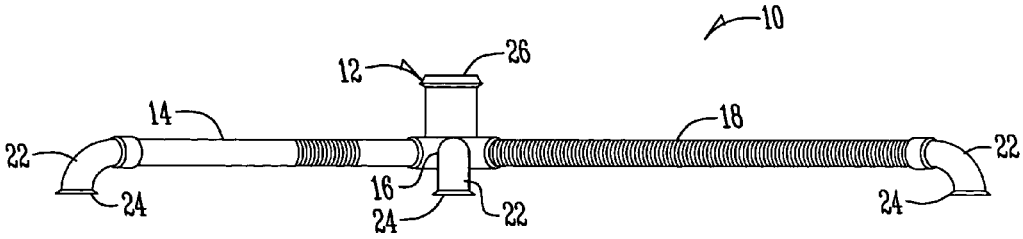
FIG. 2 is a side view of the diverter shown in FIG. 1.

Cooler air is provided to these compartments from a single location in the freezer compartment. The air tunnel diverter 10 operatively connects all of the desired compartments to this single location through a central hub 12. The central hub 12 includes an elbow-shaped fitting 25 having an opening 26 that is generally oriented in the opposite direction from that of the openings of the fittings 22 as shown in FIG. 2. The elbow-shaped fitting 25 also includes one or more (three shown) leg portions 28, 30, 32 that extend radially outwardly from the opening 26, preferably at an approximate 90 degree angle. As will be appreciated by reference to FIGS. 1–2, each of the leg portions 28, 30, 32 depart from one another angularly. The leg portions 28, 30, 32 interfit with the leg members 14, 16, 18, respectively. While three leg portions 28, 30, 32 and leg members 14, 16, 18 have been described and shown, it is to be understood that any desired number of legs may be used. The elbow fitting 25 and leg members 14, 16, 18 are preferably plastic hollow pieces, though any desired material may be used.

Figure 3:
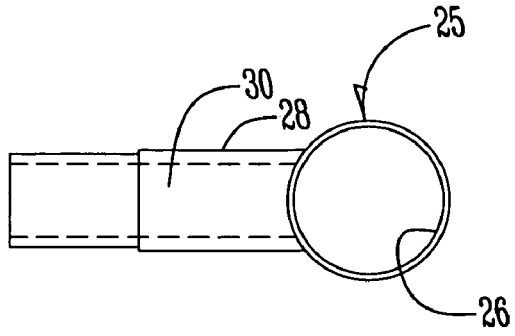
FIG. 3 is a top view, partially in phantom, of a polypropylene insert used within the hub portion of the diverter shown in FIGS. 1 and 2.
Figure 4:
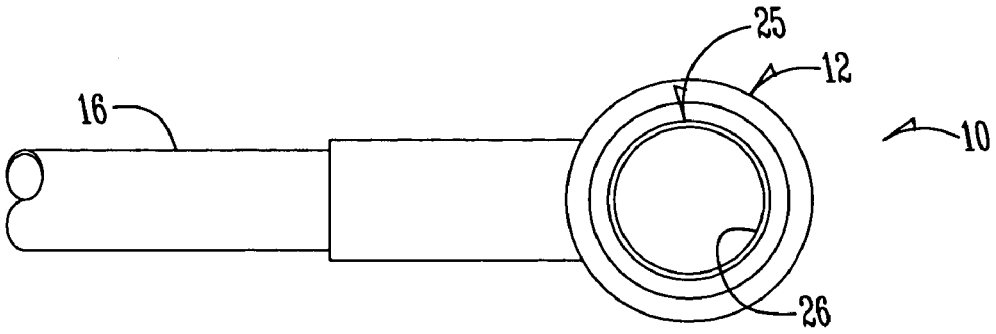
FIG. 4 is a close-up top view of the overmolded hub portion.
Figure 5:
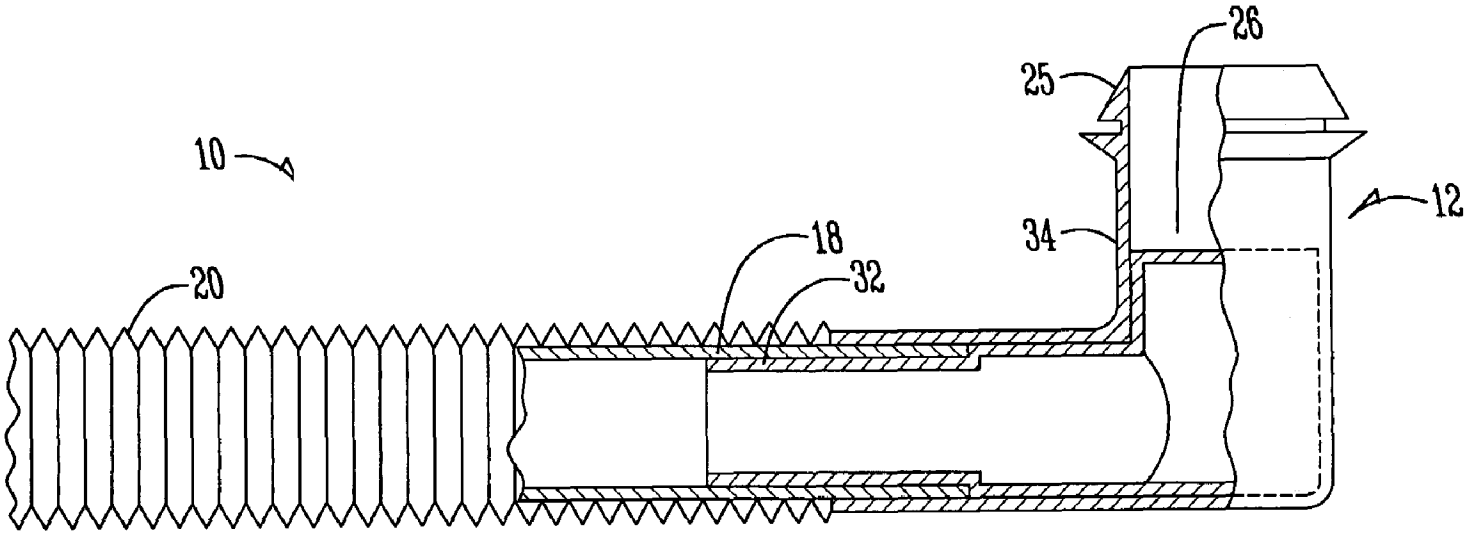
FIG. 5 is a side view, partially in phantom, of the hub area of the assembled diverter.

As shown in FIGS. 3–5, a fastening overmolding process is used to secure the fitting 25's leg portion 32 to the leg member 18 and, thereby form the hub 12. A suitable flexible plastic material, preferably a thermal plastic elastomer such as SANTOPRENE®, is disposed over the fitting 25 and the proximal ends of each of the leg member 18. This overmolded layer is indicated at 34 in FIGS. 4 and 5. By inserting the elbow fitting 25 into a mold, the flexible plastic material may be sprayed in or injected into the mold to coat, cover or otherwise secure the connection between the leg portion 32 and the leg member 18. The soft, flexible plastic seals the connection between the leg member 18 and the hub 12.

Further, a press fit connector may be formed during the overmold process. The flexibility of the plastic material used in the overmold process allows a flange or ridged and narrowing end geometry to be formed into the hub 12. This allows an installer to secure the air tunnel diverter 10 by simply pressing the hub 12 into the desired hole location within a refrigerator/freezer.

The use of the overmold process to secure the components together is advantageous as compared to prior art techniques that generally required the use of glue. The use of glue to affix three individual air tunnel tubes to a single hub was difficult and not dependable against foam leaking into the tubing.

In use, the air tunnel diverter 10 is installed within the central vertical mullion of a refrigerator or within cabinetry or other locations such that the opening 26 will receive cooled air. The openings of the elbow fitting 22 is directed into a desired space that is to be refrigerated. Typically, the elbow fitting 22 is disposed at the approximate locations of the lower meat bin or the beverage chiller compartments within the refrigerated section of a refrigerator. During fabrication of a refrigerator, the air tunnel diverter 10 is assembled, placed into the mullion and then foamed-in insulation is injected into the mullion to secure the diverter therein. Because no glue is required to assemble the air tunnel diverter 10, the foamed-in insulation will not leak into the air tunnel diverter 10. This reduces waste while minimizing assembly time. Moreover, the flexibility of the air tunnel diverter 10 allows it to be pre assembled for use in a variety of different refrigerator/freezer styles and a variety of different locations further reducing labor and manufacturing costs.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An air tunnel diverter for a refrigeration unit, the air tunnel diverter comprising:

a plastic hub having a bore disposed at least partially there through and at least one distally extending hollow stud member in communication with said bore;

a plastic coating at least partially extending beyond a proximal end of said hub, said coating being softer than said plastic hub, said coating further comprising:

a radially extending back face;

a radially extending front face; and an annular recess disposed between said faces;

at least one longitudinally extending flexible hollow lug member affixed to each of said at least one hollow stud members of said plastic hub.

* * * * *